US008975520B2

(12) United States Patent
Blake et al.

(10) Patent No.: US 8,975,520 B2
(45) Date of Patent: Mar. 10, 2015

(54) GROUND LOOP ISOLATOR FOR A COAXIAL CABLE

(75) Inventors: Joshua Blake, San Diego, CA (US); Yiping Hu, San Diego, CA (US); Huihui Fu, Shang Hai (CN)

(73) Assignee: Steren Electronics International, LLC, San Diego, CA (US)

( * ) Notice: Subject to any disclaimer, the term of this patent is extended or adjusted under 35 U.S.C. 154(b) by 542 days.

(21) Appl. No.: 13/151,039

(22) Filed: Jun. 1, 2011

(65) Prior Publication Data

US 2011/0248801 A1 Oct. 13, 2011

(51) Int. Cl.

| | |
|---|---|
| ***H01R 9/05*** | (2006.01) |
| ***H01R 13/66*** | (2006.01) |
| ***H01R 24/42*** | (2011.01) |
| ***H01R 24/54*** | (2011.01) |
| *H01R 13/622* | (2006.01) |
| *H01R 103/00* | (2006.01) |

(52) U.S. Cl.

CPC ..... *H01R 13/6658* (2013.01); *H01R 24/42* (2013.01); *H01R 24/54* (2013.01); *H01R 13/622* (2013.01); *H01R 2103/00* (2013.01)

USPC ..... 174/74 R; 174/75 C; 174/75 R; 174/76; 333/24 R; 333/172; 333/176; 333/185; 439/620.03; 439/638

(58) Field of Classification Search

CPC ..... H01R 9/0518; H01R 43/28; H01R 43/05; H01R 43/04; H01R 24/42; H01R 24/48; H03H 7/0115; H03H 7/1783; H03H 7/1791

USPC ..... 174/74 R, 75 C, 75 R, 76; 333/24 R, 185, 333/172, 176; 439/607, 620, 638

See application file for complete search history.

(56) References Cited

U.S. PATENT DOCUMENTS

| | | | | |
|---|---|---|---|---|
| 4,701,726 | A * | 10/1987 | Holdsworth | 333/185 |
| 5,278,525 | A * | 1/1994 | Palinkas | 333/175 |
| 5,384,808 | A * | 1/1995 | Van Brunt et al. | 375/257 |
| 6,794,957 | B2 * | 9/2004 | Shafer et al. | 333/185 |
| 7,323,951 | B2 * | 1/2008 | Montena | 333/175 |
| 7,414,196 | B2 * | 8/2008 | Chawgo et al. | 174/74 R |
| 7,442,084 | B2 * | 10/2008 | Montena | 439/620.03 |
| 7,618,276 | B2 * | 11/2009 | Paglia et al. | 439/322 |
| 2003/0102941 | A1 * | 6/2003 | Amano et al. | 333/202 |

* cited by examiner

*Primary Examiner* — Ishwarbhai B. Patel
*Assistant Examiner* — Paresh Paghadal
(74) *Attorney, Agent, or Firm* — ARC IP Law, PC; Joseph J. Mayo

(57) ABSTRACT

A ground loop isolator for a coaxial cable, for example that blocks DC current but which allows a desired band of RF through the ground loop isolator, and which is small enough to fit in the areas where coupling of the desired electronic equipment is to occur. Embodiments may include an outer area allowing for easier manual coupling of the coaxial cable connector nut to electronic devices.

11 Claims, 14 Drawing Sheets

GROUND LOOP ISOLATOR FOR A COAXIAL CABLE

BACKGROUND OF THE INVENTION

1. Field of the Invention

One or more embodiments of the invention are related to the field of electrical cables. More particularly, but not by way of limitation, one or more embodiments of the invention enable a ground loop isolator for a coaxial cable, for example that blocks DC current but which allows a desired band of RF through the ground loop isolator, and which is small enough to fit in the areas where coupling of the desired electronic equipment is to occur.

2. Description of the Related Art

Standard coaxial cables may be utilized to connect high frequency electronic components together. Such a cable is shown in FIG. 1. As shown, coaxial cable 101 includes cable 102 and coaxial connector 103. When coaxial cable 101 is utilized as shown in FIG. 2, grounding problems may occur when an ungrounded television or digital video recorder (DVR) is coupled via the coaxial cable with a set top box (STB) for example. This may cause a "ground loop", wherein undesired currents occur between two devices that should be, but are not at the same voltage, i.e., should be at the ground potential. In some cases, a voltage different of up to 60 volts or more may exist on the television or DVR since two-plug power cables may be utilized to power the devices, and the devices may have a significant potential with respect to ground potential voltage. When coupling a coaxial cable between the ungrounded television/DVR and the set top box, sparks may occur if the differential is high enough, thereby potentially causing a hazard.

Many ground loop isolators exist, but are generally large devices, for example that are not configured to fit in small areas such as are found behind television sets, DVRs and set top boxes. In addition, since many set top boxes are configured to output a radio frequency signal for channel 2, 3 or 4, ground loop isolators that utilize "chokes", i.e., capacitor and inductor filters may limit the radio frequency signals in this range, which defeats the purpose of a ground loop isolator for coaxial cable scenarios, since the radio frequency at least in the range used between the set top box and the television may be blocked by the choke.

For at least the limitations described above there is a need for a ground loop isolator for a coaxial cable, for example that blocks DC current but which allows a desired band of RF through the ground loop isolator, and which is small enough to fit in the areas where coupling of the desired electronic equipment is to occur.

BRIEF SUMMARY OF THE INVENTION

One or more embodiments described in the specification are related to a ground loop isolator for a coaxial cable. Embodiments of the invention may include a transformer and/or other electrical components such as capacitors for example to form a filter that does not allow direct current to pass from one side of the ground loop isolator to the other side, but which allows a desired band of radio frequency voltage through the ground loop isolator. In addition, embodiments of the invention may be physically configured to be small enough to fit in the areas where coupling of the desired electronic equipment is to occur. Embodiments may include an outer area allowing for easier manual coupling of the coaxial cable connector nut or male connector to electronic devices.

BRIEF DESCRIPTION OF THE DRAWINGS

The above and other aspects, features and advantages of the invention will be more apparent from the following more particular description thereof, presented in conjunction with the following drawings wherein.

DETAILED DESCRIPTION OF THE INVENTION

A ground loop isolator for a coaxial cable will now be described. In the following exemplary description numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

Embodiments of the invention may include a transformer and/or other electrical components such as capacitors for example to form a filter that does not allow direct current to pass from one side of the ground loop isolator to the other side, but which allows a desired band of radio frequency voltage through the ground loop isolator. In addition, embodiments of the invention may be physically configured to be small enough to fit in the areas where coupling of the desired electronic equipment is to occur. Embodiments may include an outer area configured to enable easier manual coupling of the coaxial cable connector nut or male connector, whether integrated into the embodiment or not, to electronic devices.

Figure 1:
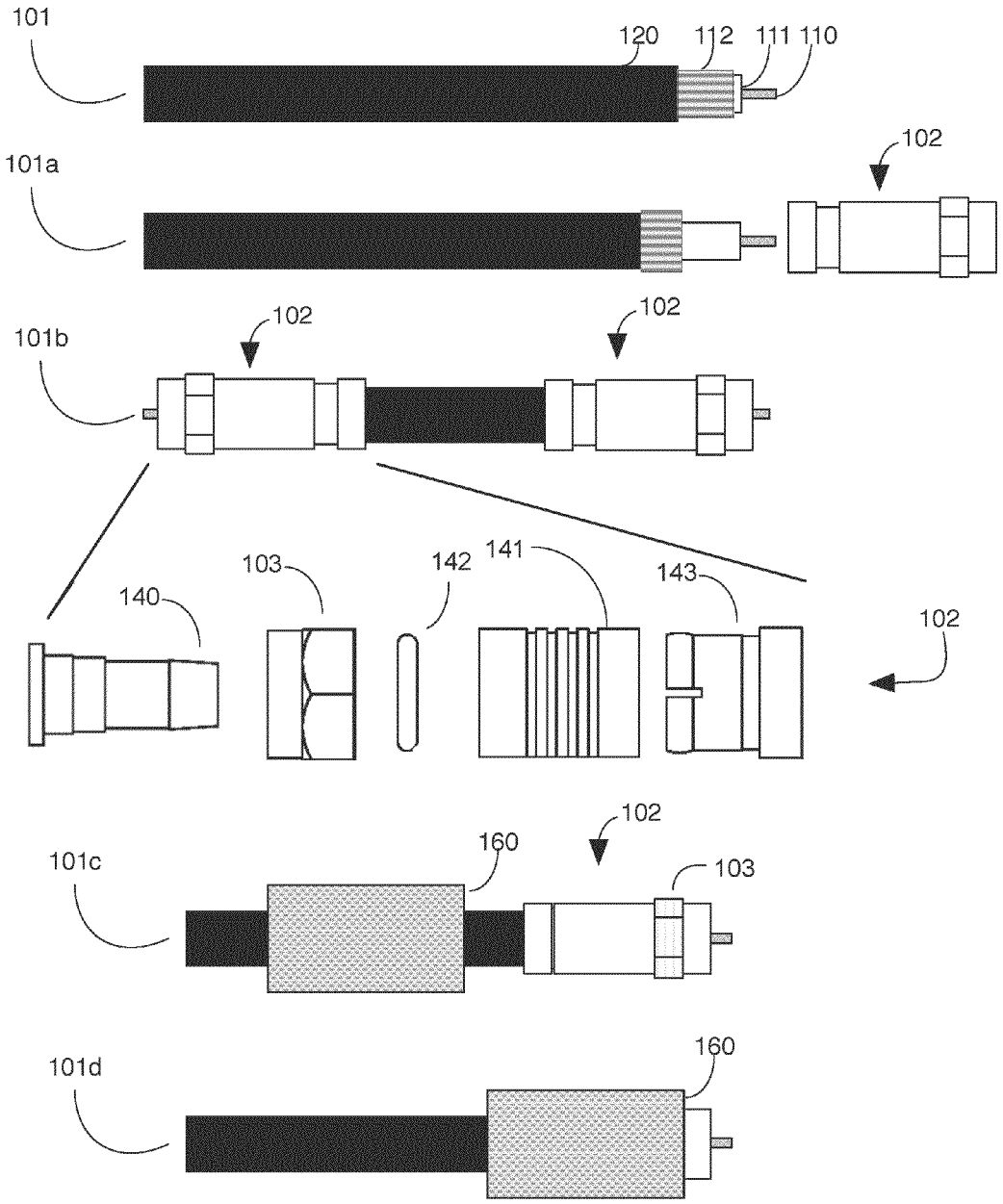
FIG. 1 illustrates coaxial cable coupled with a coaxial cable connector.
Figure 4:
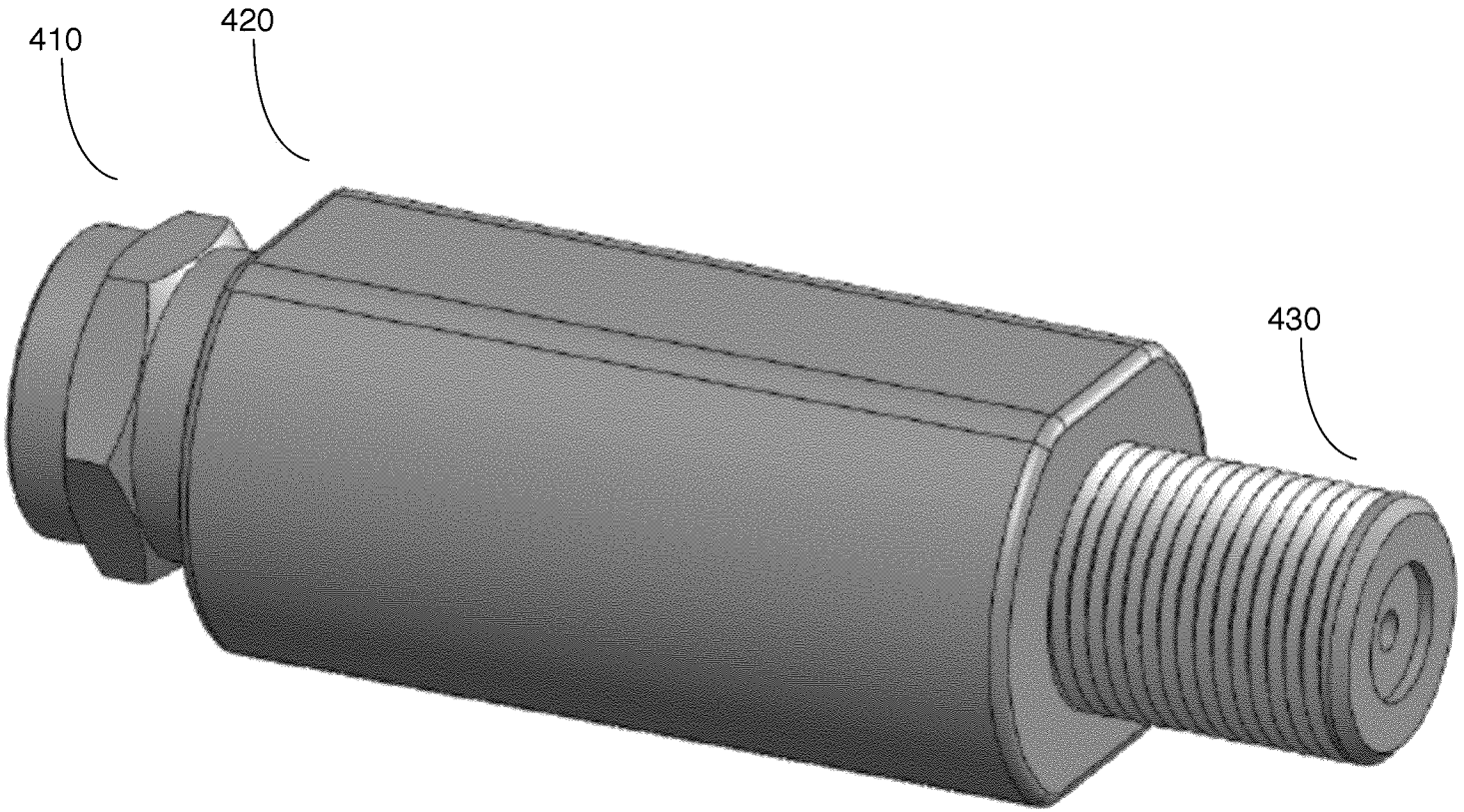
FIG. 4 illustrates an embodiment of the invention having a male and female interface.

FIG. 1 illustrates coaxial cable coupled with a coaxial cable connector. Coaxial cable 101 generally includes a conductor or central wire 110, that is surrounded by a dielectric 111, which is further surrounded by braided shielding 112, which is further surrounded by an outer insulating jacket 120. The cable is generally prepared for coupling with a coaxial cable connector via a tool that removes portions of the cable as shown in prepared cable 101*a*, thereby exposing the conductor, dielectric and shielding. As shown in the blow up of coaxial cable connector 102 below cable 101*b*, coaxial cable connector 102 or coaxial connector for short includes a post 140, situated inside nut 103 that is rotationally coupled with the coaxial cable 101*b*, optionally with O-ring 142, and a collar 141, which is also known as a body, that forms the main outer cylinder of the coaxial connector and which is held onto cable 101*b* via sleeve 143, for example via a compression coupling with cable 101*b* as is known in the art. Shown in the bottom two cable depictions, rotation aid 160 (which may form cover 420 as is shown in FIG. 4) is placed on the cable, optionally before coaxial cable connector 102 is crimped onto cable 101*c* and then coupled with nut 103 to form cable 101*d* with rotational aid for coupling nut 103 onto electrical equipment. These components in this configuration are also described in the parent patent application that has been incorporated by reference herein.

Figure 2:
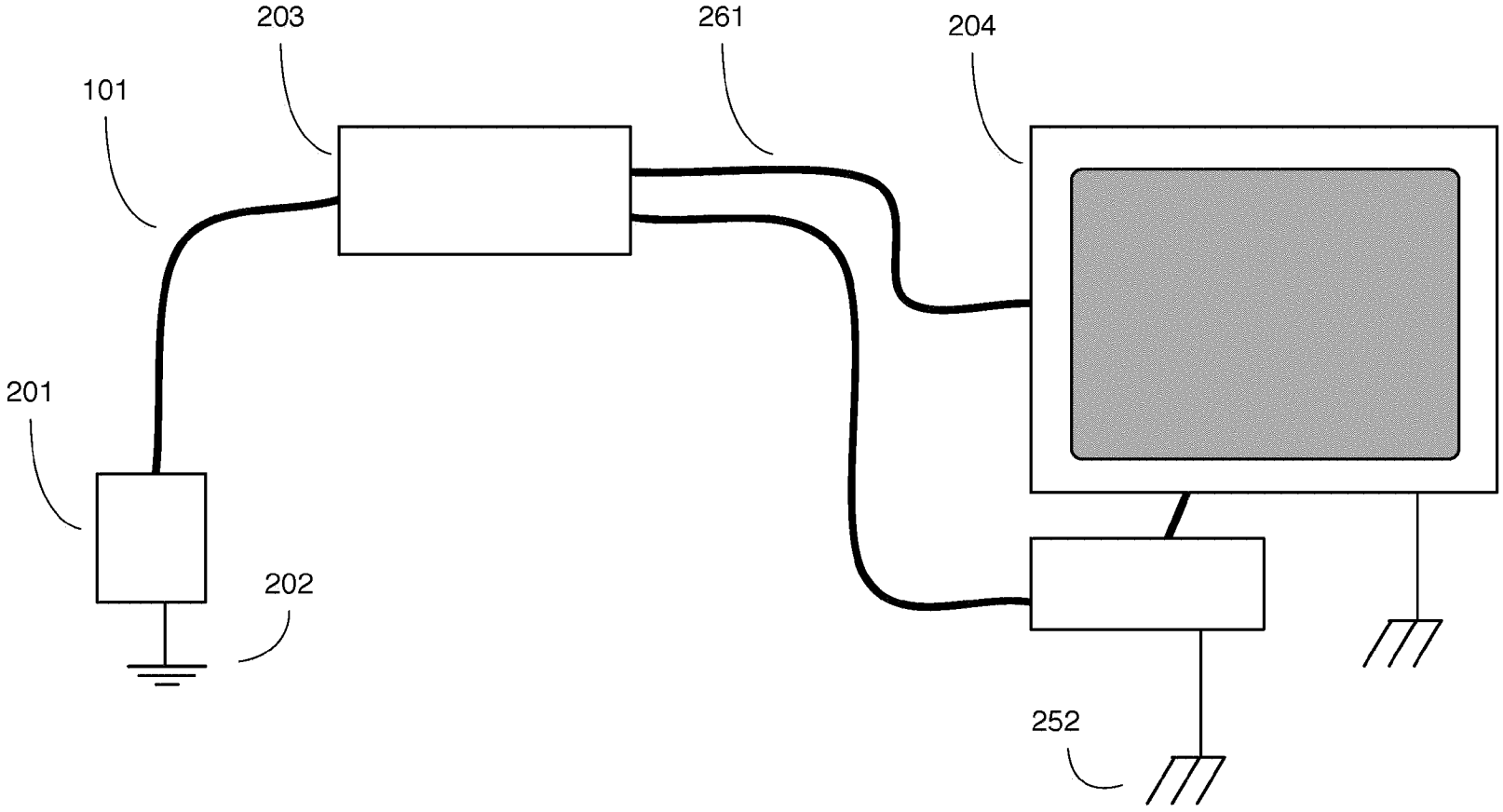
FIG. 2 illustrates a system diagram having a coaxial cable that is grounded by a coaxial cable junction box for example and a set top box that is thus grounded and that is connected to an ungrounded television and/or digital video recorder.

FIG. 2 illustrates a system diagram having coaxial cable 101 that is for example grounded by coaxial cable junction box 201 having ground line 202, and set top box 203 that is thus indirectly grounded via ground line 202. Set top box 203 is further connected to an ungrounded television 204 and/or digital video recorder 205, both of which also float with respect to ground as per negative terminals of their two-prong electric power cords, wherein the power cords are ungrounded as they do not have a third ground line. When coaxial cable 261 is connected between set top box 203 and ungrounded television 204, a ground loop may be established wherein a hazardous spark may occur when coaxial cable 261 nears or touches ungrounded television 204 since the chassis of the ungrounded television may be at a different electrical potential with respect to ground as opposed to set top box 203 which is effectively grounded to coaxial cable junction box 201 through the outer shielding layer of the coaxial cable itself. This configuration and many others like it where some video components are grounded and some are not, or where some are grounded to a different ground point or circuit are examples where hazardous sparks may occur.

Embodiments of the invention are configured to isolate the potential difference between the grounded and ungrounded electrical components from direct current while allowing radio frequency electrical signals to pass only if the signals are within a desired band of frequencies corresponding to channels 2, 3 or 4 for example (or any other desired channels) that are utilized to deliver any number of television channels input to set top box 203 and output from set top box 203 on channels 2, 3 or 4 to the older television. In this manner, the set top box is utilized to select a channel while the older television merely is set to receive a given channel that does not change when the set top box channel is changed. Embodiments of the invention may also be configured to attenuate radio frequency signals that are not within this desired band. In addition, embodiments of the invention may be provided in any form factor required to fit within the generally small area behind electrical components. One or more embodiments of the invention may be coupled with an existing coaxial cable connector before coupling an embodiment of the invention with ungrounded television 204 or DVR 205.

Figure 3:
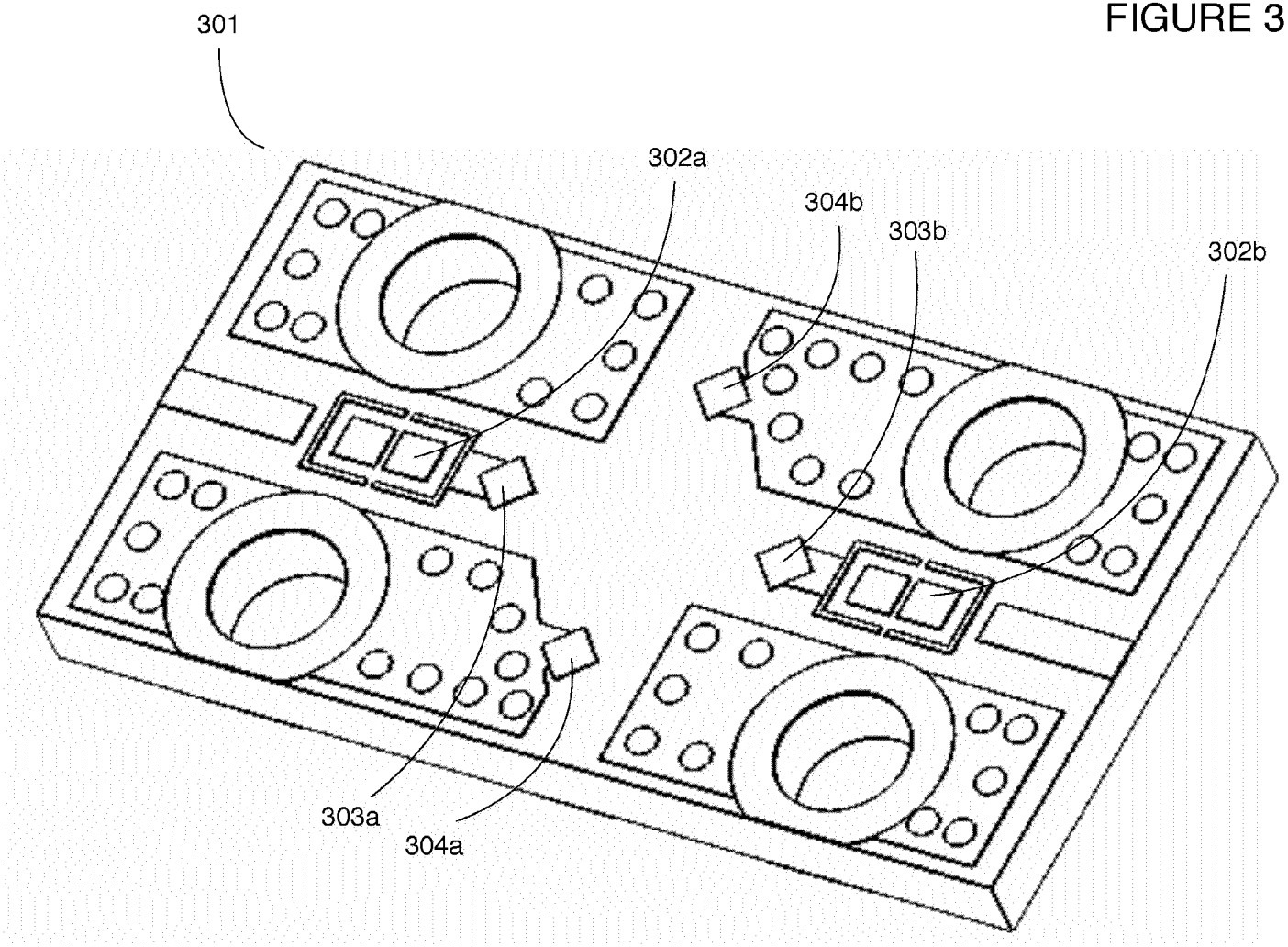
FIG. 3 illustrates a printed circuit board configured to hold the components that are utilized to isolate one side of the ground loop isolator from direct current from the other side, and which are also configured to allow a band of radio frequency voltage to pass between the two sides.

FIG. 3 illustrates printed circuit board 301 configured to hold the components that are utilized to isolate one side of the ground loop isolator from direct current from the other side, and which are also configured to allow a band of radio frequency voltage to pass between the two sides. As shown, a pair of contact points at 302*a* (two squares next to each other) allow for mounting a capacitor therebetween. Contact points 303*a* and 304*a* allow for coupling one coil of a transformer onto printed circuit board 301. Contact points 303*b* and 304*b* allow for coupling a second coil to a transformer that is insulated from the first coil to allow only alternating current to pass between opposing sides of the circuit. Contact points 302*b* (two squares next to each other), allow for mounting a capacitor on the opposing side of the circuit with respect to contact points 302*a*. This allows for filtering the frequencies that are passed between one side of the circuit to the other. Any other filter configuration that can be made to fit within a coaxial cable connector with or without a rotation aid is in keeping with the spirit of the invention. The 4 holes in printed circuit board 301 may be utilized to couple shield to the printed circuit board to inhibit interference of external electrical signals. In the perspective view, the two holes on the left side "a" side of the circuit may couple with one shield, while the opposing two holes shown on the right side may couple with a second shield for example.

FIG. 4 illustrates an embodiment of the invention having male coaxial cable interface 410 coupled with an embodiment of the ground loop isolator, having cover 420 that is further coupled with female coaxial cable interface 430. Cover may be made from an insulating material in one or more embodiments of the invention and may be manufactured via extrusion molding, or may be injection molded over the PCB and shields for example. In other embodiments of the invention, cover 420 may extend over nut 410, which forms a portion of the male connector, and engage the nut so as to rotate the nut, while being rotationally coupled over the remainder of the PCB and female coaxial cable interface 430 for example. In other embodiments of the invention, cover has a threaded area molded into it so that a metallic nut is not required. In this embodiment a metallic coating, or conductive plastic for example may be utilized if desired to provide shielding. See FIG. 13 for an illustration of this embodiment.

Figure 5:
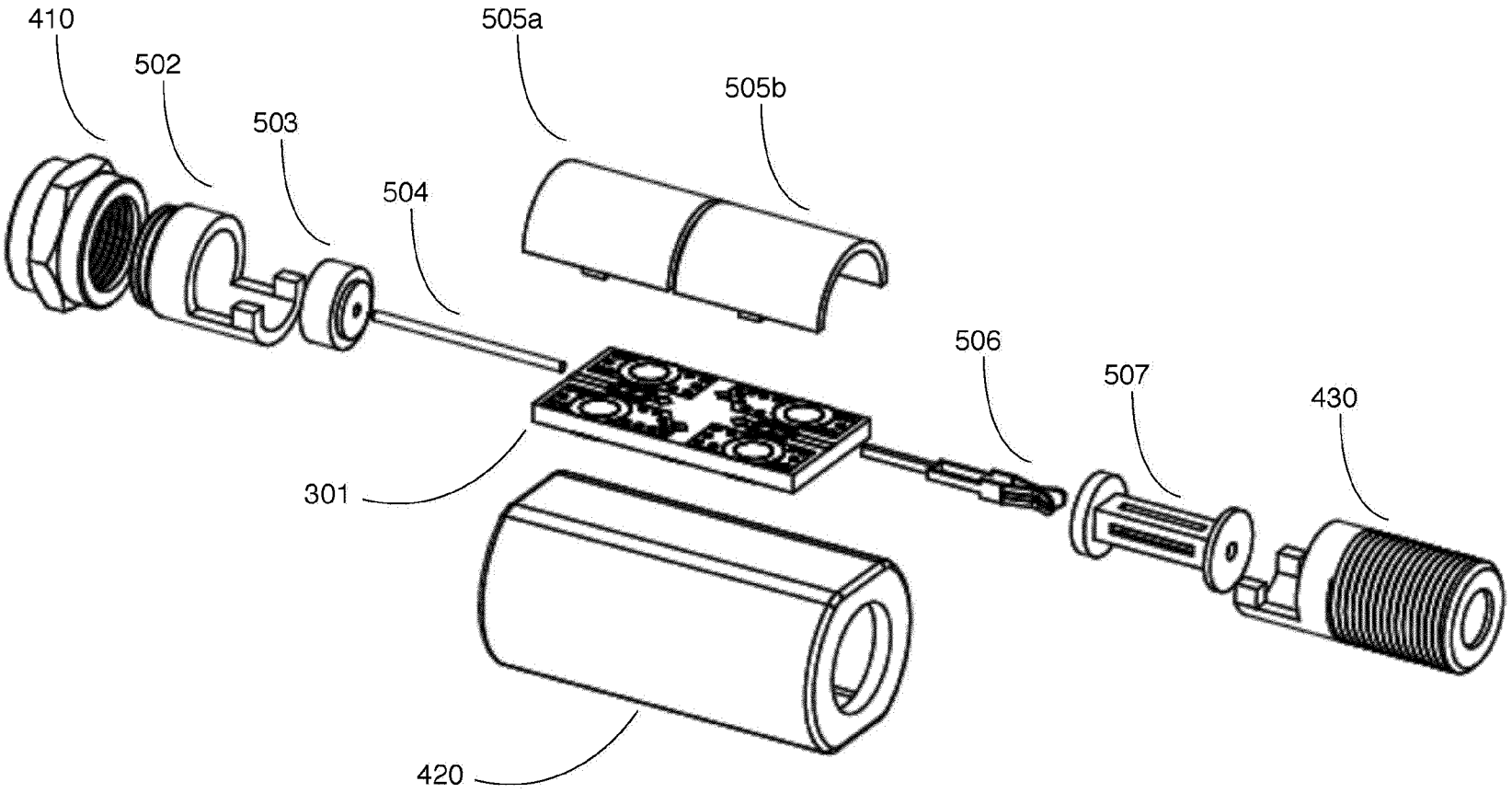
FIG. 5 illustrates an exploded view of the embodiment of the invention shown in FIG. 4.

FIG. 5 illustrates an exploded view of the embodiment of the invention shown in FIG. 4. As shown, nut 410 is configured for rotational coupling with male collar 502. Together, nut 410 and male collar 502 combine to form a male connector wherein the nut is capable of rotation, with respect to the male collar, about the longitudinal axis of the cable. Male collar 502 is configured to hold male connector dielectric 503 that includes a hole that allows male connector pin 504 to pass through male connector dielectric 503, male collar 502 and nut 410. Male connector pin is configured on the opposite side to couple with PCB 301. The internal components of the ground loop isolator couple with wire (see FIGS. 14 and 15), which is isolated from direct currents that could flow from female connector pin 506, that is coupled to the opposing side of PCB 301. The components that allow radio frequency signals to pass from one side of PCB 301 to the other include a transformer for example with a ferrite core in one or more embodiments. First shield 505*a* and second shield 505*b* are configured to attenuate external radio frequency signals that may enter the components on PCB 301. The shields have small extensions on the bottom of them as shown that couple with the holes previously described with respect to FIG. 3, for example with solder. First shield 505*a* and second shield 505*b* are separated by a gap between them as shown, so that the two shields do not form a direct electrical connection and so that direct currents cannot pass between them as they are both in electrical contact with the respect coaxial interfaces on each side of the apparatus. On the female side of apparatus, female connector pin 506 includes a forked section shown on the right, which allows for a wire from a coaxial cable to enter between the forks and make electrical contact. Female connector pin 506 resides in female connector dielectric 507 that couples with female connector 430. Cover 420 can be made a thick or thin as is required for the specific application. In one or more embodiments of the invention, cover may include a faceted area to allow for easier coupling with an electrical component by providing a facet for a wrench or a human hand to gain a better grip on the apparatus. In one or more embodiments, cover 420 forms an outer manual rotation aid, which is described in further detail in FIG. 13.

Figure 6:
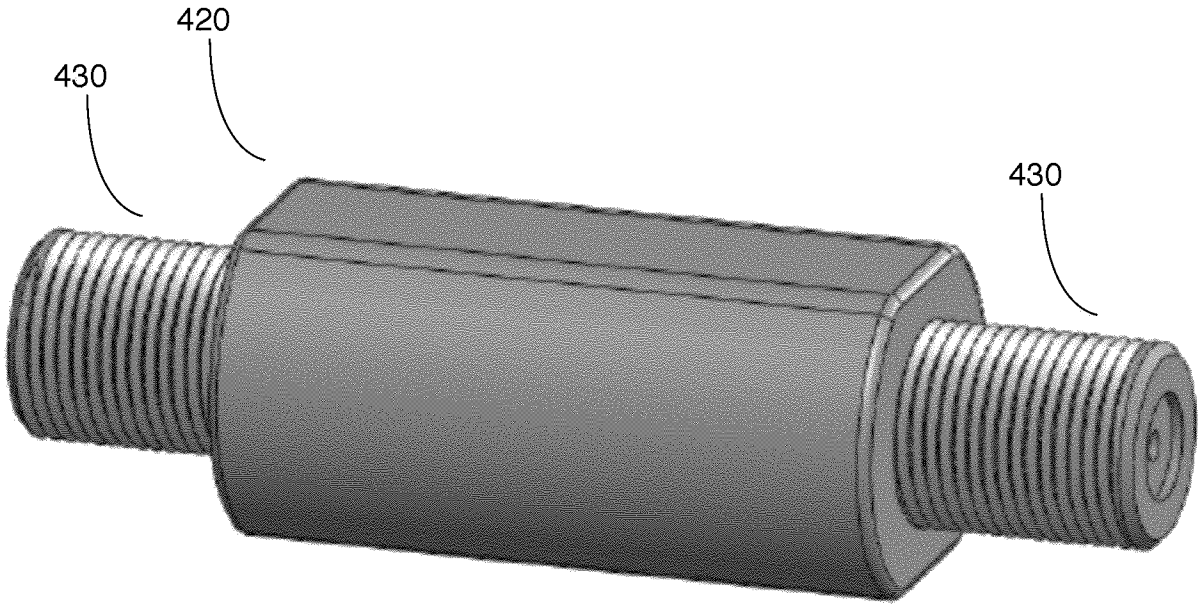
FIG. 6 illustrates an embodiment of the invention having two female interfaces.

FIG. 6 illustrates an embodiment of the invention having two female interfaces 430. One or more of the female interfaces may couple in a rotational manner with cover 420, or may couple with cover 420 in a manner which does not allow for axial rotation with respect to cover 420. An outer manual rotation aid may couple to one or more of the female interfaces, or alternatively none or one of the female interfaces. See FIG. 13.

Figure 7:
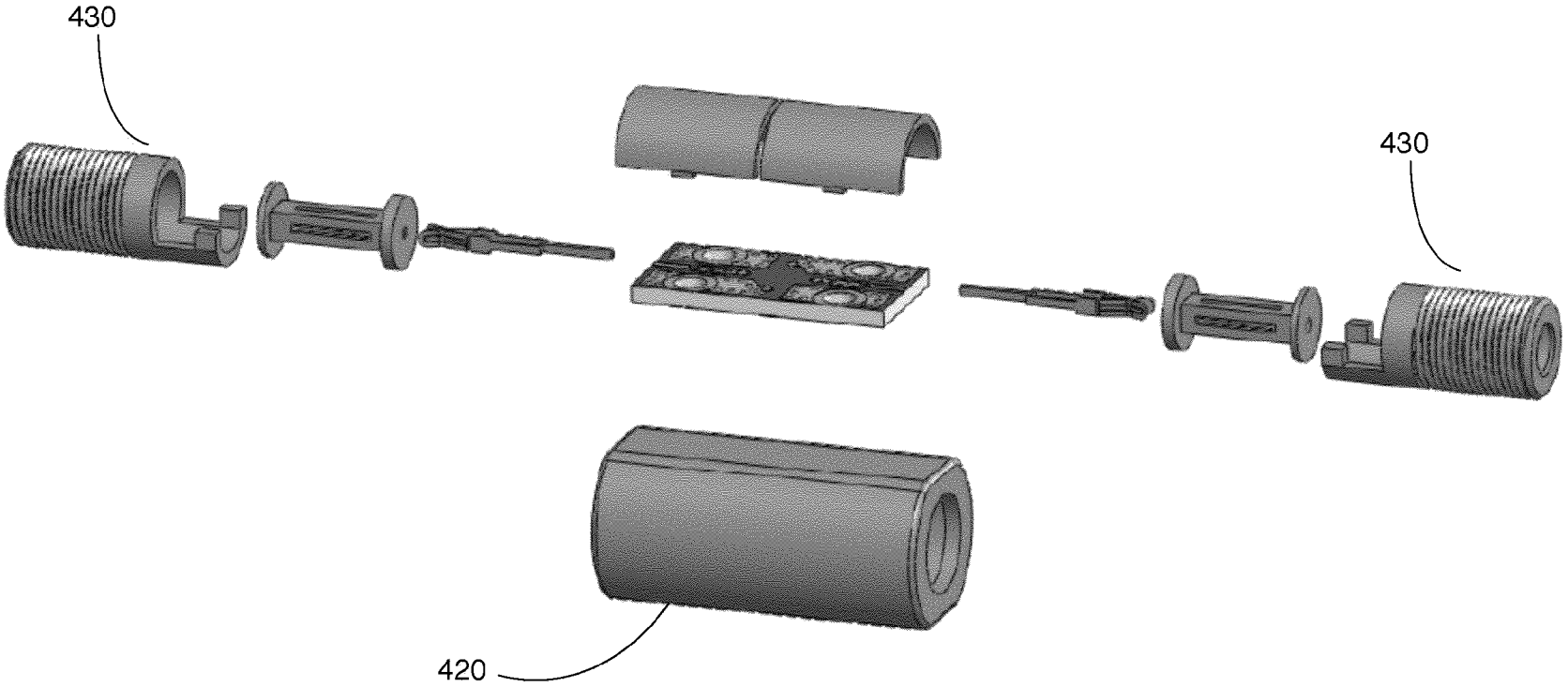
FIG. 7 illustrates an exploded view of the embodiment of the invention shown in FIG. 6.

FIG. 7 illustrates an exploded view of the embodiment of the invention shown in FIG. 6. This embodiment allows for two male cables to couple with the apparatus. The female components are described with respect to FIG. 5, however two sets of female components are utilized instead of one as described in FIG. 5.

Figure 8:
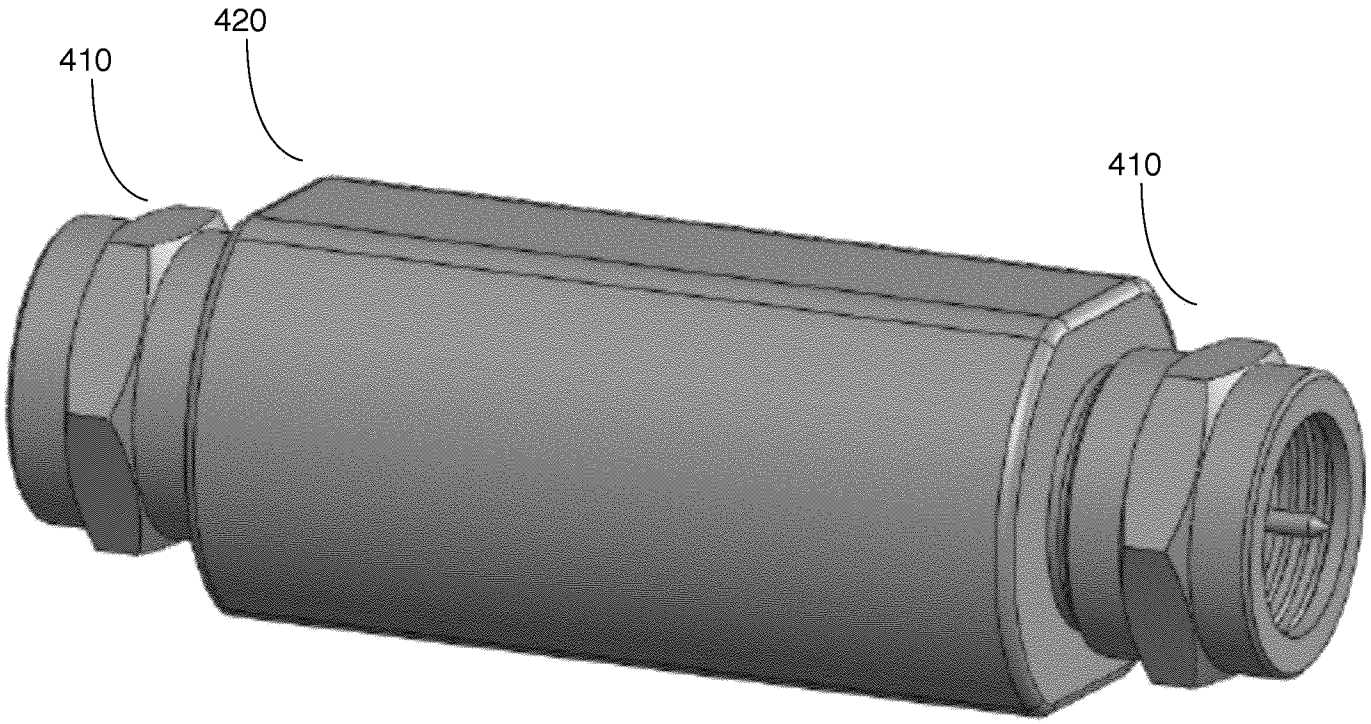
FIG. 8 illustrates an embodiment of the invention having two male interfaces.

FIG. 8 illustrates an embodiment of the invention having two male interfaces 410. One or more of the male interfaces may couple in a rotational manner with cover 420, or may couple with cover 420 in a manner which does not allow for axial rotation with respect to cover 420 and hence forms an outer manual rotation aid. See FIG. 13.

Figure 9:
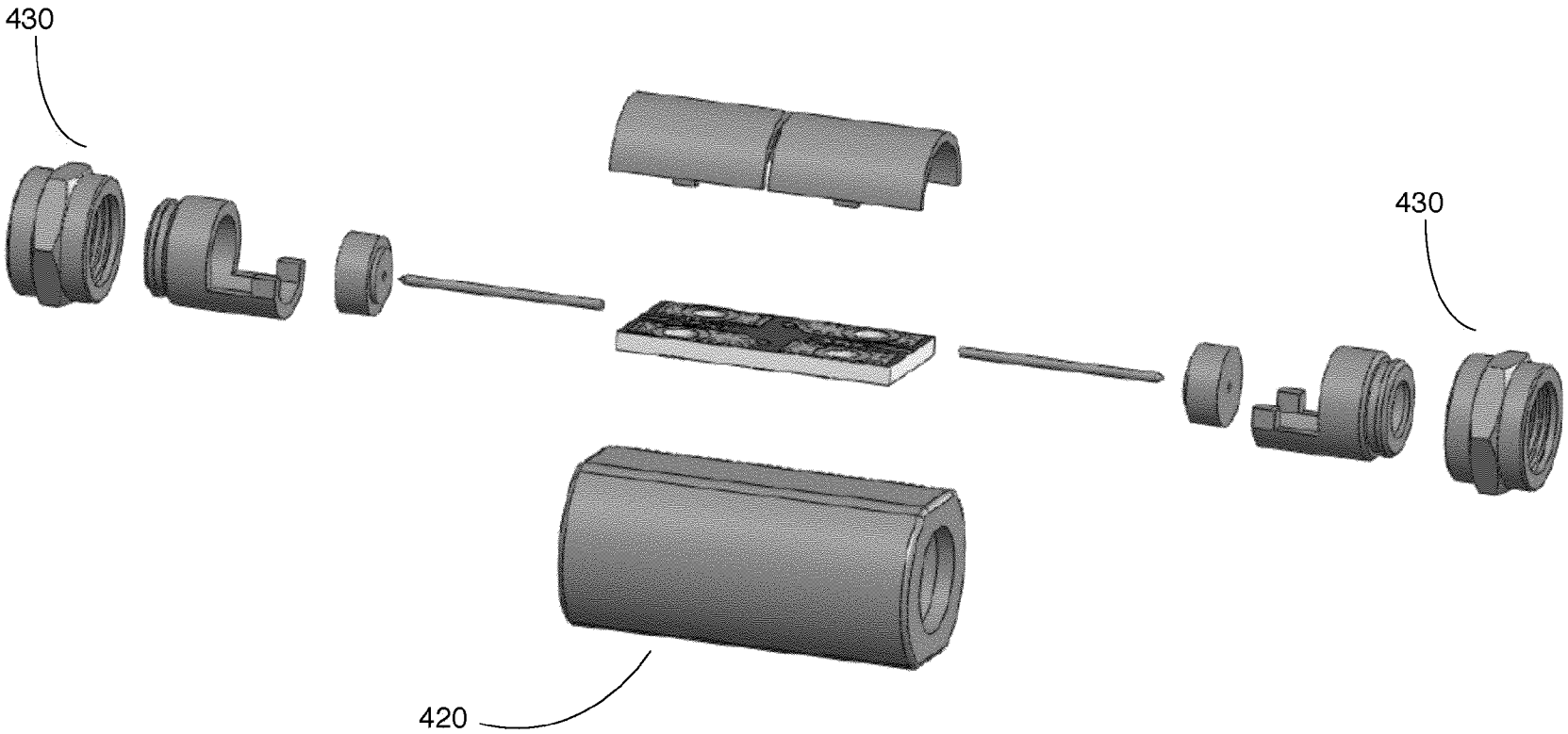
FIG. 9 illustrates an exploded view of the embodiment of the invention shown in FIG. 9.

FIG. 9 illustrates an exploded view of the embodiment of the invention shown in FIG. 9. This embodiment allows for two female cables to couple with the apparatus. The male components are described with respect to FIG. 5, however two sets of male components are utilized instead of one as described in FIG. 5.

Figure 10:
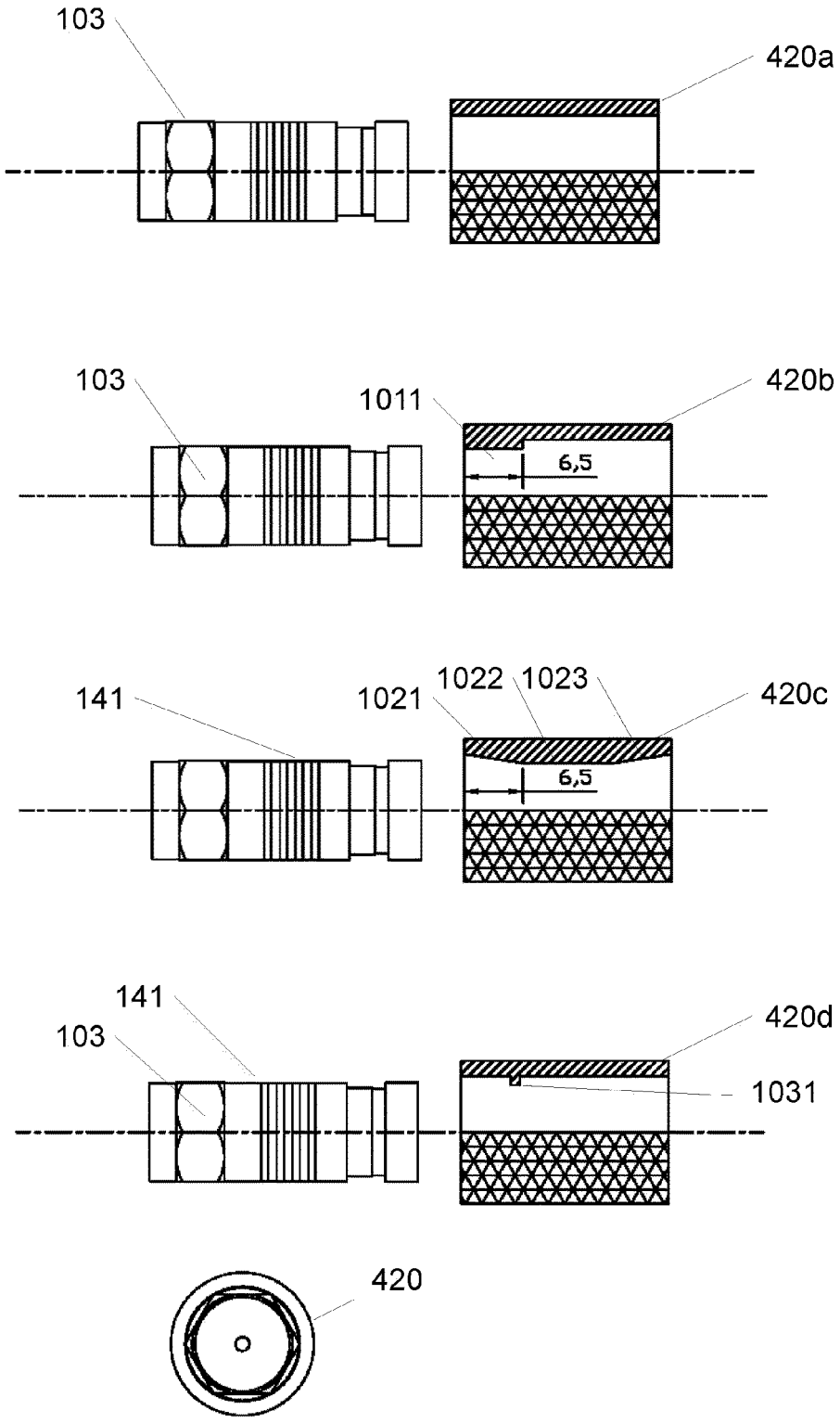
FIG. 10 illustrates embodiments of the outer manual rotation aid, without an outer faceted area for use with a wrench, which is configured to allow for easier manual coupling of the apparatus to electrical components.

FIG. 10 illustrates embodiments of the outer manual rotation aid that may also be utilized as cover 420, without an outer faceted area for use with a wrench, which is configured to allow for easier manual coupling of the apparatus to electrical components. The four embodiments shown have different interior variations to allow for engaging the nut, which may gouge the inner portion of the rotation aid in a manner that allows for removal of the rotation aid and subsequent use of the aid on the other end of the cable. These embodiments may be made of an insulating material, or a material that has a shield embedded inside of the insulating material for example. The first embodiment 420*a* is a straight cylinder, the second embodiment 420*b* has an area of thinner inner diameter 1011 that allows for engaging the nut, while the second diameter provides for more clearance around the collar, body or housing of the apparatus. The third embodiment 420*c* has ramps one or both sides 1021 and 1023 with narrower area 1022 so as to allow for easy engagement of the nut, while allowing for the nut to be placed at the other end of the cable without removing the apparatus from the cable, so that for example children cannot swallow the apparatus for example. This is true of all embodiments. In the fourth embodiment 420*d*, a small retaining diameter or "stop" 1031 that enables the rotation aid to engage the apparatus between the nut and the housing for example.

Figure 11:
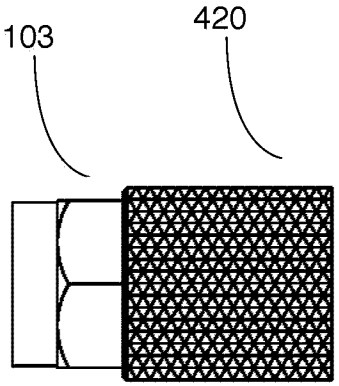
FIG. 11 illustrates an embodiment of the outer manual rotation aid, with an outer faceted area for use with a wrench, that is configured to allow for easier manual coupling of the apparatus to electrical components, while still allowing for use of a wrench to couple the apparatus to electrical components.

FIG. 11 illustrates an embodiment of the outer manual rotation aid, with an outer faceted area for use with a wrench, that is configured to allow for easier manual coupling of the apparatus to electrical components, while still allowing for use of a wrench to couple the apparatus to electrical components. Embodiments of the invention may be constructed out of plastic for example. In this embodiment, a separate nut is not needed since the rotation aid includes a threaded area inside that enables the apparatus to screw onto a coaxial interface via the threaded area.

Figure 12:
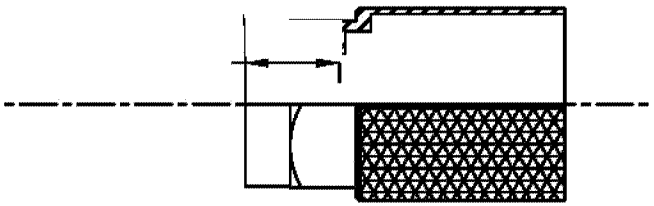
FIG. 12 illustrates a cutaway view of the embodiment shown in FIG. 11.

FIG. 12 illustrates a cutaway view of the embodiment shown in FIG. 11. This embodiment may utilize a smaller inner diameter portion to engage between the collar and the housing for example, see also FIG. 10.

Figure 13:
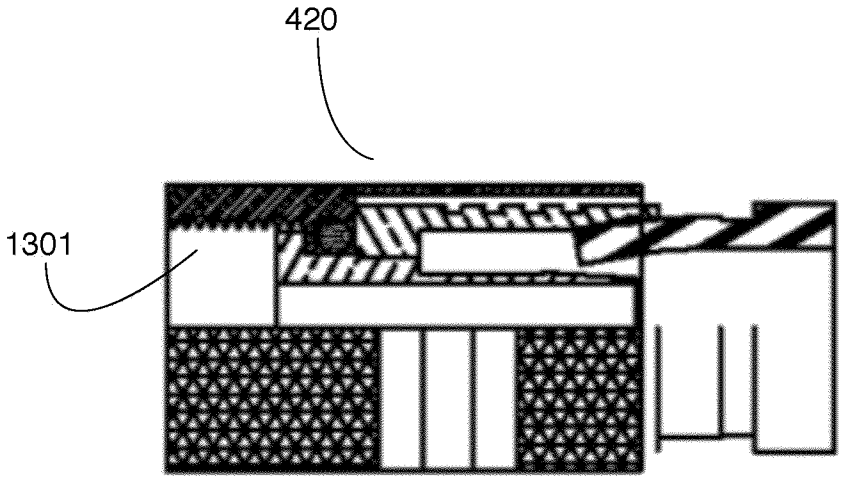
FIG. 13 illustrates a cutaway view of a variation of an embodiment of the outer manual rotation aid have an inner integrated threaded portion which may be utilized in place of a separate coaxial cable connector nut or male connector.

FIG. 13 illustrates a cutaway view of a variation of an embodiment of the outer manual rotation aid 420 have an inner integrated threaded portion 1301 which may be utilized in place of a separate coaxial cable connector nut. In this embodiment, facets are not utilized on the outer portion of the rotation aid with respect to the embodiment shown in FIGS. 11 and 12.

Figure 14:
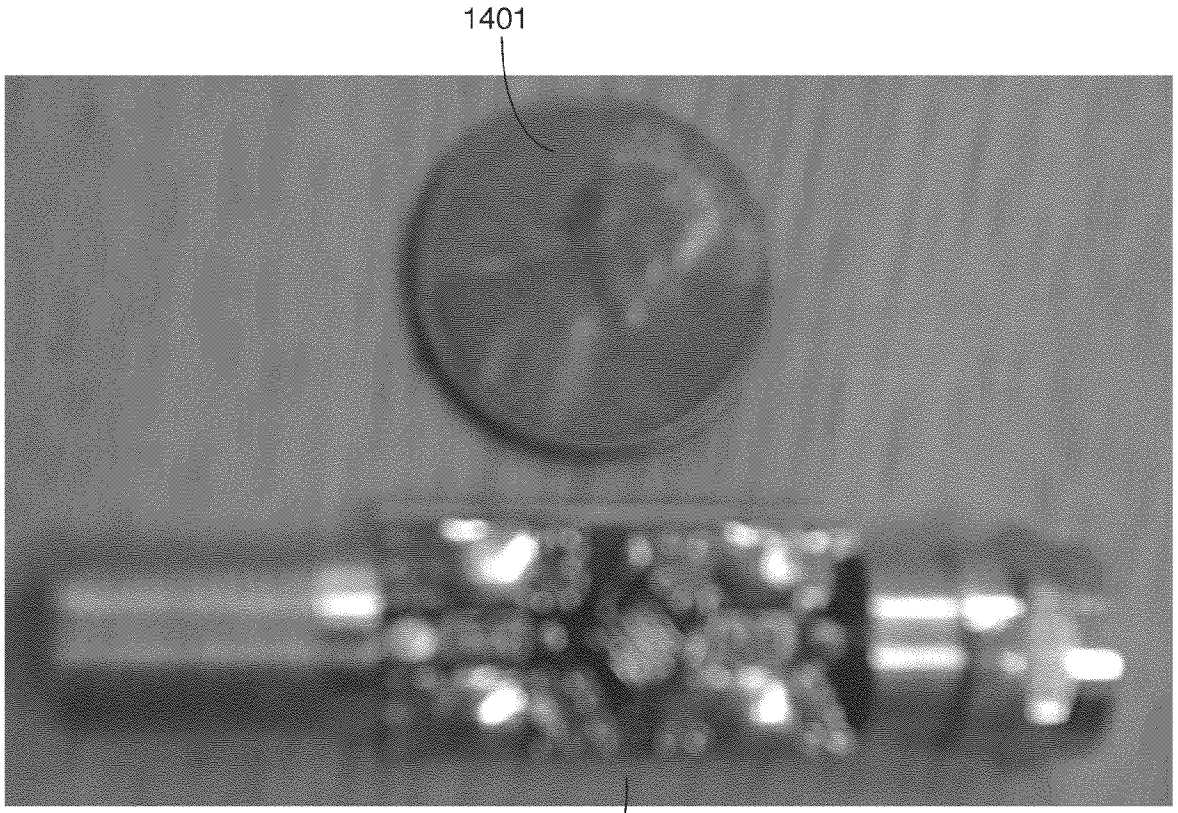
FIG. 14 illustrates an embodiment of the invention showing the components on a printed circuit board without the outer cover or manual rotation aid installed so as to show a physical implementation of the embodiment shown in FIG. 3. Coin 1401 shows the relative size of the components on printed circuit board 301.

FIG. 14 illustrates an embodiment of the invention showing the components on a printed circuit board without the outer cover or manual rotation aid installed so as to show a physical implementation of the embodiment shown in FIG. 3.

Figure 15:
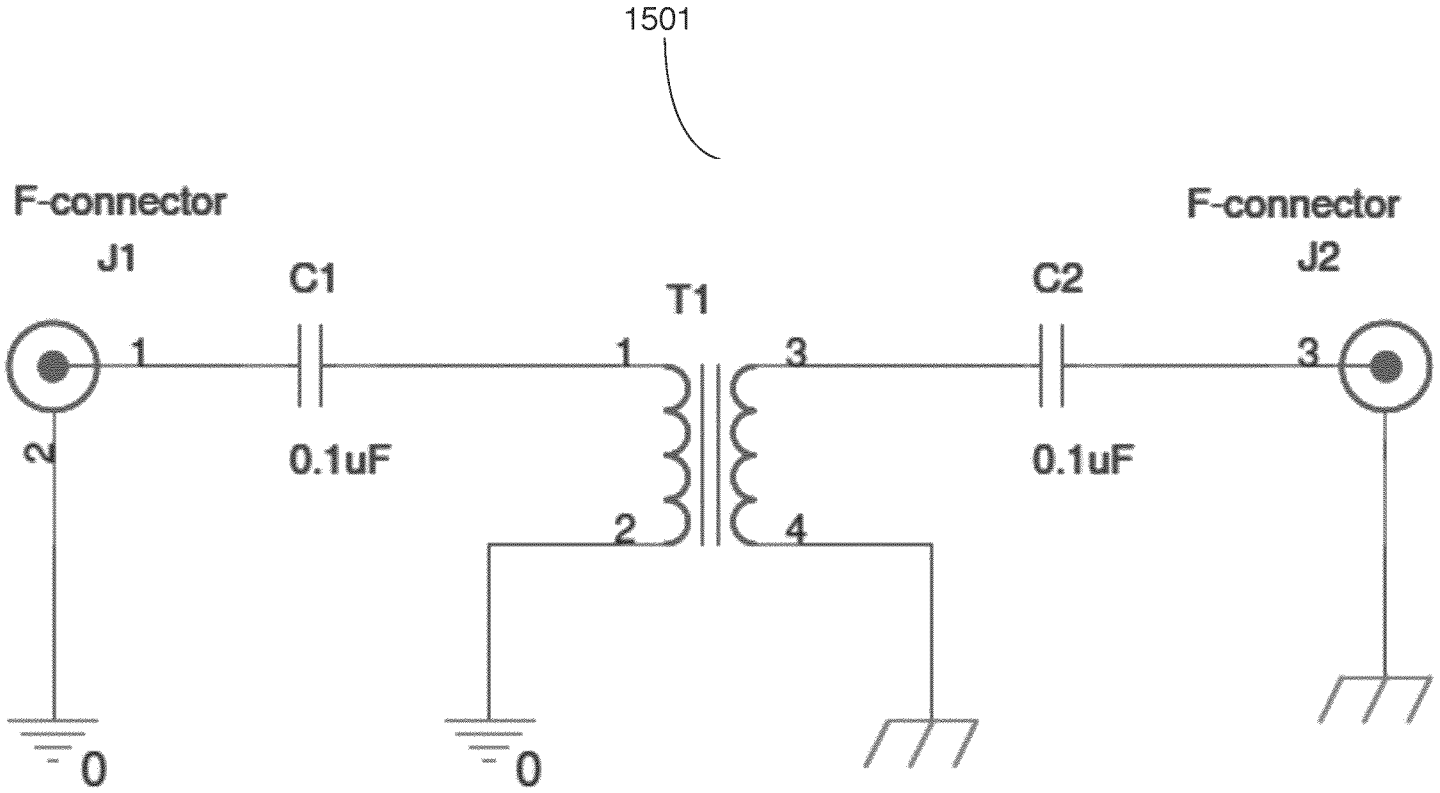
FIG. 15 illustrates a circuit diagram for the electrical components that install on the printed circuit board of FIG. 3.

FIG. 15 illustrates a circuit diagram for the electrical components that install on the printed circuit board of FIG. 3. Connector J1 may be implemented as a male or female connector as desired. When connector J1 is coupled with electrical equipment that is grounded, a path 2 to ground 0 is formed at the outer portion of connector J1. A conductive path 1 couples electrically to an inner portion of connector J1 and with capacitor C1. Capacitor C1 is mounted on printed circuit board 301 between contacts at 302*a* (between the two adjacent square pads). Capacitor C1 couples with transformer T1 inductively, via electrical path 1 having a coiled wire section that coils about the transformer and which continues to electrical path 2 and on to ground 0. The transformer, for this conductive path may be coupled at 303*a* and 304*a* in FIG. 3 for example. Path 3 also includes a coiled section about transformer T1 that couples inductively with transformer T1 and continues to a common voltage point 4, generally floating and not conductively coupled with ground 0. Path 3 also couples electrically with capacitor C2. Electrical paths 1 and 3 are insulated from one another to prevent a direct current path from one side of the device to the other. Path 3 couples capacitor C2 to an inner conductive portion of connector J2. The outer portion of connector J2 is electrically coupled to a common voltage point 4 as is the opposing side of the coil of path 3, which generally is not grounded as the opposing side of the circuit is.

While the invention herein disclosed has been described by means of specific embodiments and applications thereof, numerous modifications and variations could be made thereto by those skilled in the art without departing from the scope of the invention set forth in the claims.

What is claimed is:

1. A ground loop isolator for a coaxial cable comprising:

a first threaded element configured to couple with a first coaxial cable interface wherein said first threaded element surrounds a first electrical conductor;

a second threaded element configured to couple with a second coaxial cable interface wherein said second threaded element surrounds a second electrical conductor;

a ground loop isolator circuit coupled on one side with said first electrical conductor situated within said first threaded element and on an opposing side with said second electrical conductor situated within said second threaded element;

said ground loop isolator circuit configured to prevent direct current from travelling from said first electrical conductor to said second electrical conductor, and isolate said one side of the ground loop isolator from direct current from said opposing side;

a first shield configured to cover said one side of said ground loop isolator circuit and said first electrical conductor;

a second shield configured to cover said opposing side of said ground loop isolator circuit and said second electrical conductor;

said first shield and said second shield configured to reside a positive distance away from one another to form a gap and configured to shield said ground loop isolator circuit from external radio frequency electrical signals and further configured to prevent direct current from passing between said first shield and said second shield as a result of said gap; and, wherein said ground loop isolator circuit comprises a transformer having a first and second insulated coil wound about said transformer wherein said first insulated coil is coupled with said first electrical conductor forming a first electrical path on said one side that is grounded, and wherein said second insulated coil is coupled with said second electrical conductor forming a second electrical path on said opposing side that continues onto a floating voltage point that is not grounded, such that said first electrical path and said second electrical path are insulated from one another; and, wherein said first electrical path that is grounded is not connected to said second electrical path that is not grounded.

2. The ground loop isolator for a coaxial cable of claim 1, further comprising a band pass filter coupled to at least said first electrical conductor, wherein said band pass filter is configured to allow at least one television channel frequency to pass through said ground loop isolator circuit and attenuate at least one other television channel frequency.

3. The ground loop isolator for a coaxial cable of claim 1, further comprising a band pass filter coupled to at least said first electrical conductor, wherein said band pass filter is configured to allow at least one television channel frequency to pass through said ground loop isolator circuit and attenuate at least one other television channel frequency above said at least one television channel frequency.

4. The ground loop isolator for a coaxial cable of claim 1, further comprising a band pass filter coupled to at least said first electrical conductor, wherein said band pass filter is configured to allow at least one television channel frequency to pass through said ground loop isolator circuit and attenuate at least one other television channel frequency below said at least one television channel frequency.

5. The ground loop isolator for a coaxial cable of claim 1, further comprising a band pass filter coupled to at least said first electrical conductor, wherein said band pass filter is configured to allow at least one television channel frequency to pass through said ground loop isolator circuit and attenuate at least one other television channel frequency above and below said at least one television channel frequency.

6. The ground loop isolator for a coaxial cable of claim 1, wherein said first threaded element is female and said second threaded element is male.

7. The ground loop isolator for a coaxial cable of claim 1, wherein said first threaded element is female and said second threaded element is female.

8. The ground loop isolator for a coaxial cable of claim 1, wherein said first threaded element is male and said second threaded element is male.

9. The ground loop isolator for a coaxial cable of claim 1, further comprising:

an outer housing configured to surround said first shield and said second shield.

10. A ground loop isolator for a coaxial cable comprising:

a first threaded element configured to couple with a first coaxial cable interface wherein said first threaded element surrounds a first electrical conductor;

a second threaded element configured to couple with a second coaxial cable interface wherein said second threaded element surrounds a second electrical conductor;

a ground loop isolator circuit coupled on one side with said first electrical conductor situated within said first threaded element and on an opposing side with said second electrical conductor situated within said second threaded element;

wherein said ground loop isolator circuit comprises a transformer having a first and second insulated coil wound about said transformer wherein said first insulated coil is coupled with said first electrical conductor forming a first electrical path on said one side that is grounded, and wherein said second insulated coil is coupled with said second electrical conductor forming a second electrical path on said opposing side that continues onto a floating voltage point that is not grounded, such that said first electrical path and said second electrical path are insulated from one another;

wherein said first electrical path that is grounded is not connected to said second electrical path that is not grounded;

said ground loop isolator circuit configured to prevent direct current from travelling from said first electrical conductor to said second electrical conductor, and isolate said one side of the ground loop isolator from direct current from said opposing side;

a first shield configured to cover said one side of said ground loop isolator circuit and said first electrical conductor;

a second shield configured to cover said opposing side of said ground loop isolator circuit and said second electrical conductor;

said first shield and said second shield configured to reside a positive distance away from one another to form a gap and configured to shield said ground loop isolator circuit from external radio frequency electrical signals and further configured to prevent direct current from passing between said first shield and said second shield as a result of said gap.

11. The ground loop isolator for a coaxial cable of claim 10, further comprising a band pass filter coupled to at least said first electrical conductor, wherein said band pass filter is configured to allow at least one television channel frequency to pass through said ground loop isolator circuit and attenuate at least one other television channel frequency.

* * * * *